United States Patent [19]

Iorns

[11] Patent Number: 5,024,557

[45] Date of Patent: Jun. 18, 1991

[54] METHOD AND APPARATUS FOR CONSTRUCTING AN OFFSHORE HOLLOW COLUMN

[76] Inventor: Martin E. Iorns, 1512 Lakewood Dr., West Sacramento, Calif. 95691

[21] Appl. No.: 99,406

[22] Filed: Sep. 22, 1987

[51] Int. Cl.[5] ..... E02D 23/00

[52] U.S. Cl. ..... 405/223; 425/63

[58] Field of Search ..... 405/155, 223, 195, 222; 264/32, 33, 34, 228; 425/63, 64, 65

[56] References Cited

U.S. PATENT DOCUMENTS

| | | | |
|---|---|---|---|
| 3,249,664 | 5/1966 | Georgii | 405/223 X |
| 3,652,755 | 3/1972 | Iorns et al. | 264/34 X |
| 3,928,104 | 12/1975 | Luckett et al. | 264/228 X |
| 4,030,864 | 6/1977 | Einstabland | 425/65 |
| 4,110,991 | 9/1978 | Torkuhl | 405/155 X |
| 4,443,131 | 4/1984 | Olsen | 405/222 X |
| 4,664,556 | 5/1987 | Dixon | 405/223 |

*Primary Examiner*—David H. Corbin

[57] ABSTRACT

A method and apparatus for forming a hollow column of concrete on a floating offshore platform by applying successive layers of concrete and reinforcing to a single surface slipform which outlines the inner or outer contour of the column. The column is intermittently or continuously lowered by means of gravity under the control of one or more cables. The column may be round, oval, rectangular or of any cross section, or any combination thereof, and may be open or closed at either end or at intermediate levels. The column may be segmented into sections and have relatively thin walls as in an OTEC cold water pipe, an outfall sewer, or an underwater tunnel; and a method is described for safely deploying such columns at great depth on to an uneven seabed. The column may be monolithic with walls thick enough to support a structure above the surface or to maintain the hollow interior at amospheric pressure and provide access to an undersea habitat or to gas and oil well equipment. Air chambers with air lines leading to the surface may be placed at various levels on or within the wall to provide a means for adjusting the immersed weight of the column.

11 Claims, 4 Drawing Sheets

METHOD AND APPARATUS FOR CONSTRUCTING AN OFFSHORE HOLLOW COLUMN

BACKGROUND OF THE INVENTION

1. Field of the Invention

The invention relates to an apparatus and a method for forming and deploying a fully or partially immersed hollow concrete column designed for but not limited to providing a pipe for bringing cold water from the depths, for conducting sewage offshore, for building underwater tunnels, for supporting a structure above the surface, or for providing access to an undersea habitat or a subsea chamber which houses oil well equipment at atmospheric pressure.

2. Prior Art

| References: | | |
|---|---|---|
| 3,249,664 | 5/66 Georgii | 264/88 |
| 3,652,755 | 3/72 Iorns et al. | 264/219 |
| 3,928,104 | 12/75 Luckett et al. | 156/171 |
| 4,030,864 | 6/77 Einstabland et al. | 425/65 |
| 4,443,131 | 4/84 Olsen | 405/203 |
| 4,664,556 | 5/87 Dixon | 405/223 |

Large diameter concrete pipe has been considered unsuitable for use as the cold water pipe in Ocean Thermal Energy Conversion (OTEC) systems because of weight but has been widely used for outfall sewers. Pipe was fabricated on shore by conventional methods in segments whose size was limited by the capacity of the lifting and transporting equipment available. These segments were then transported to the construction site and assembled by various means to form an outfall sewer. Another method used horizontal floating forms which were periodically opened as the concrete hardened and then repositioned, but shifting of the forms was comparatively complicated, time-consuming and difficult to keep watertight.

It is also known to build caissons by pouring concrete between double forms and lowering the caisson as the pouring proceeds. The weight of the caisson is transferred to its floating support through the upper, last-poured portion of the caisson and its form, so that method can be used only for caissons having a comparatively short vertical length. The method is sensitive to wave motions which cause relative movements between the form and the upper part of the caisson which has not yet completely set.

U.S. Pat. No. 3,928,104 discloses a method and apparatus for manufacturing concrete pipes by depositing a layer of green concrete (i.e., concrete which has not set) on a mandrel, winding helically a flexible, binding member to consolidate and retain the concrete on the mandrel and winding wire reinforcing with substantial tension to prestress the pipe. The flexible binding member prevents the wire reinforcing from cutting into the green concrete and is an essential element in the method. By contrast, the present invention applies green concrete to the form by spraying with sufficient velocity to cause the concrete to adhere to the form and does not require a flexible binding to hold or protect the initial layer of concrete. Reinforcing wire needs to be applied with only enough tension to keep it in place.

It is also known to prestress concrete tanks by winding wire around the exterior and tensioning with special equipment. Prestressing is commonly used to reduce weight and control cracking in concrete. The present invention can use laminated ferrocement as disclosed in the inventor's prior U.S. Pat. No. 3,652,755 to achieve the same result in a thinner wall.

In norway, hollow monolithic thick-walled concrete columns for supporting oil rigs have been built on a floatable platform in a graving dock by placing concrete between sliding inner and outer forms, known in the trade as slipforms, which are raised by mechanical means as construction progresses.

As offshore structures became larger and heavier, inclined columns were needed to spread the heavy load over a broad base. U.S. Pat. No. 4,030,864 describes an apparatus for slipforming including free-standing hollow columns of concrete, but the degree of inclination and height of such columns is severely restricted without an elaborate supporting framework. U.S. Pat. No. 4,443,131 describes a further method in which columns are cast in a vertical position with conventional slipforms, then tilted toward each other and permanently connected together to form a support for the superstructure. The present invention eliminates the need for the mechanical jacks, jigs, and attachments required to raise slipforms yet also permits inclining columns to any angle without an elaborate supporting structure.

U.S. Pat. No. 3,249,664 discloses a method in which a comparatively short end section of the desired column is built first, which one end closed, then floated on the water with its open end projecting above the surface. Conventional forms or slipforms are mounted on the exposed rim and the entire weight of the concrete and formwork is supported by the upward thrust of the surrounding water. Since the form is attached to the column, no relative movement can occur between the concrete and the form due to wave action. As new concrete is added and gains strength, water is introduced into the cavity of the column to keep the forms at working level. When completed, the upper end may be closed and the water pumped out to bring the column into a horizontal position for towing. When the concrete column must have open ends, e.g., for tunnel sections, the first fabricated end section is made removable and can be used to start other sections. The present invention does not require an end piece to start production.

Suitable fabricating sites for the systems described above were often at a considerable distance from the installed site, resulting in high transportation costs. Further, the assembly and deployment of the final structure involved complicated equipment and risk, especially at depths below the reach of human divers.

The concept of applying successive layers of mortar or concrete to form a marine structure was disclosed by this inventor and his associate in U.S. Pat. No. 3,652,755, but was limited to the interior surface of a discrete female mold, whereas the present invention applies layers of concrete to either the interior of the exterior surface of a slipform.

Said patent also required that the reinforcing be forcibly pressed into the concrete while still in the plastic state by means of a special tool, whereas the present invention permits construction of both a reinforced and an unreinforced column by shotcrete methods without special tooling other than the apparatus hereinafter described.

SUMMARY OF THE INVENTION

The present invention differs from most of the prior art in that only one surface is used as a form. This single form can be made of lightweight, semi-rigid materials or can be a flexible membrane, whereas the prior art double forms needed to hold concrete in the fluid state must be rigid and well braced. Walls built with a single form can be thinner and more highly reinforced than is possible for concrete poured between double forms.

OBJECTS OF THE INVENTION

A main object of the invention is to provide a useful and new method and apparatus for constructing hollow columnar structures of large size and great length suitable for use at great depths, together with a new system for their deployment.

Another advantage of the present invention is that the placing of the concrete is open to visual inspection instead of being concealed by the closed forms, thus permitting a higher degree of quality control.

Another advantage is that wall thickness can be varied without complicated formwork adjustment.

Another advantage is that concrete composition and density may be varied within the wall cross section to create a high-strength outer skin over a lightweight concrete or foam core. The core may be an insulating material to minimize warming of the cold water supply for an OTEC plant or cooling of the effluent from a thermal vent.

Another advantage is that the equipment can be used in tandem to increase production or facilitate multiwall construction.

Another advantage is that bulges can be easily formed in or on the wall to accommodate fastenings and inclusions, or to provide air chambers for controlling the immersed weight of the column.

Another advantage is that neither the method nor the apparatus imposes any size or weight limits on the final structure.

Another advantage is that construction can take place on-site in remote locations, using portable equipment and local labor.

BRIEF DESCRIPTION OF THE DRAWINGS

The invention shall be described in connection with the the accompanying drawings wherein.

DESCRIPTION OF THE PREFERRED EMBODIMENTS

Figure 1:
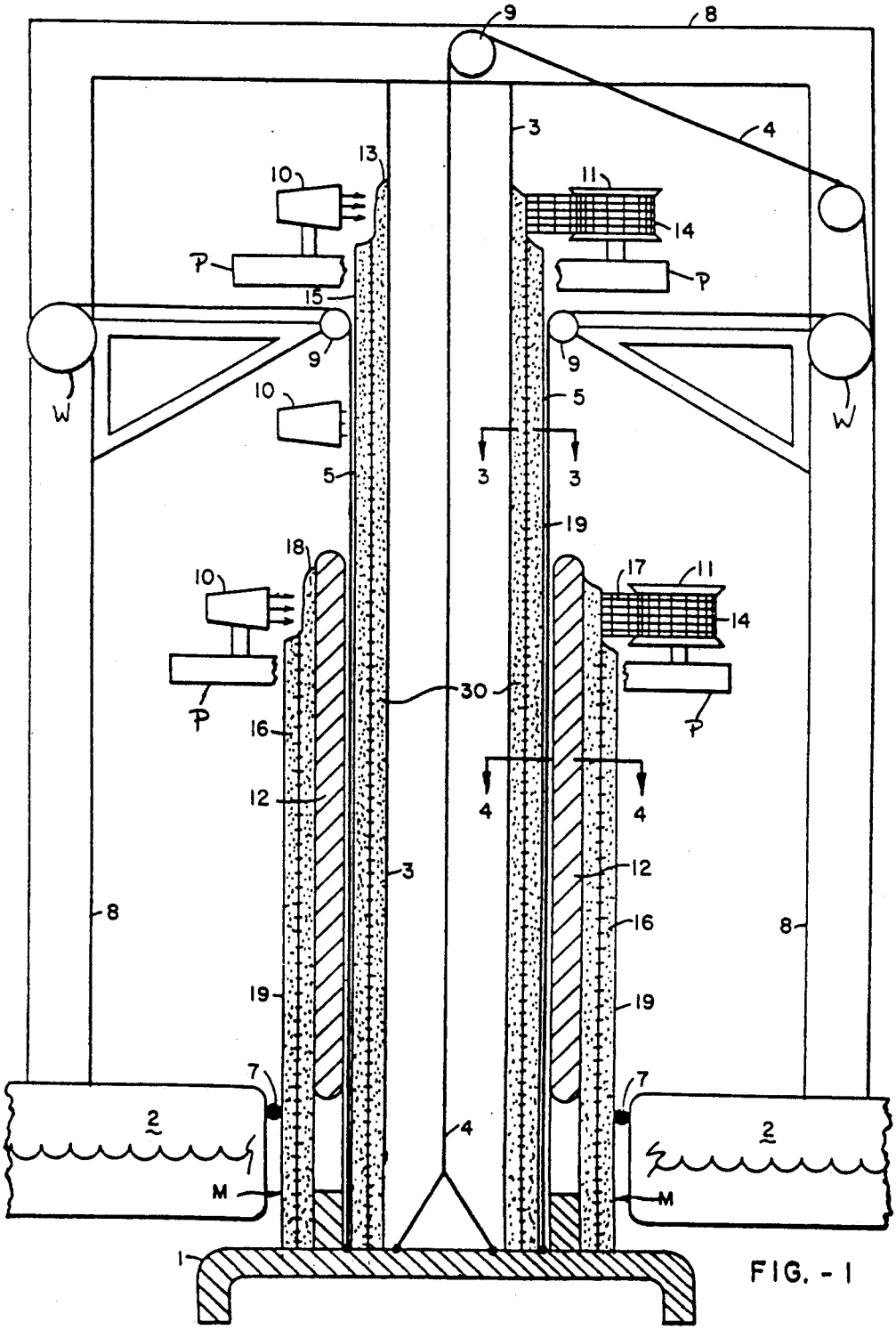
FIG. 1 is a vertical view in cross section across the centerline of a moonpool of the production platform showing a thin-wall column with air chambers and cables included.

A floating platform 2 which may be a ship, a barge, or a pontoon specifically built for the purpose and preferably containing a moonpool M, is positioned at or nearby the place where a hollow column 30 is to be installed. See FIG. 1. A bottom structure 1 which may be an anchor, a cold water intake for an OTEC plant, a diffuser for an outfail sewer, an undersea habitat, a one-atmosphere chamber for access to subsea oil and gas equipment, or other terminating structure may be fabricated on deck or in floating formwork alongside the platform and may be provided with sufficient compartmentation or other devices to make it buoyant until flooded.

A single surface form 3 corresponding to the interior configuration of the column 30 is suspended from a frame 8 over the moonpool M. Alternatively, the form 3 may be suspended from a boom (not shown) projecting over the side of the platform in which case the form 3 may be placed on the bottom structure 1 by means of the boom. When working through a moonpool M, one or more pulleys 9 are hung from the frame 8 or beam directly over the point or points where a cable 4 or cables are to be positioned for controlling the lowering of the column during construction. At least one cable 4, preferably enclosed in a flexible chase, is run from a winch W, over the pulley 9, down through the hollow form 3, under the platform 2, and brought to the surface alongside the platform 2 where it is attached to the bottom structure 1. The bottom structure 1 is then deballasted to slightly negative buoyancy and is pulled into position below the moonpool M by means of the cable 4.

Figure 2:
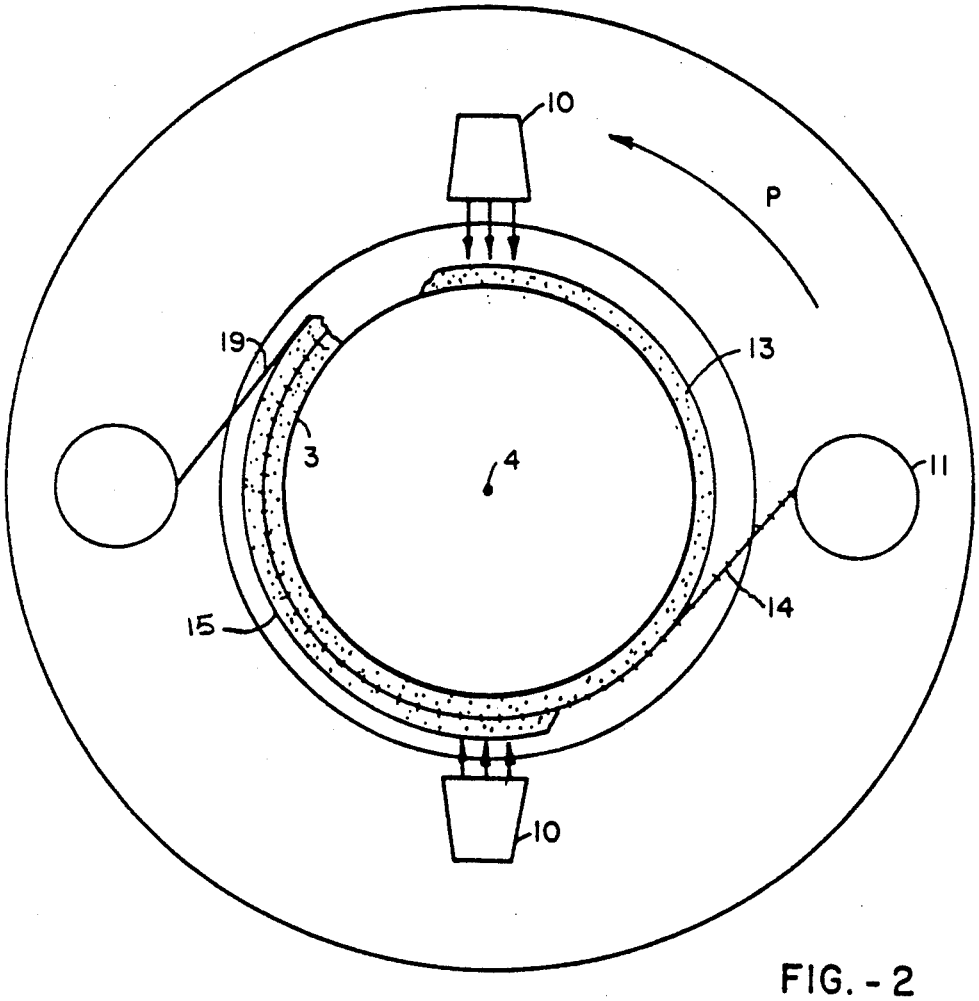
FIG. 2 is a top plan view of a modification of FIG. 1.
Figure 3:
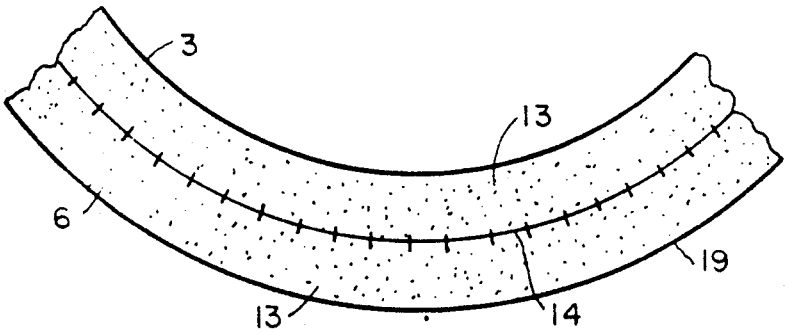
FIG. 3 is a cross section taken along lines 3—3 of FIG. 1.
Figure 4:
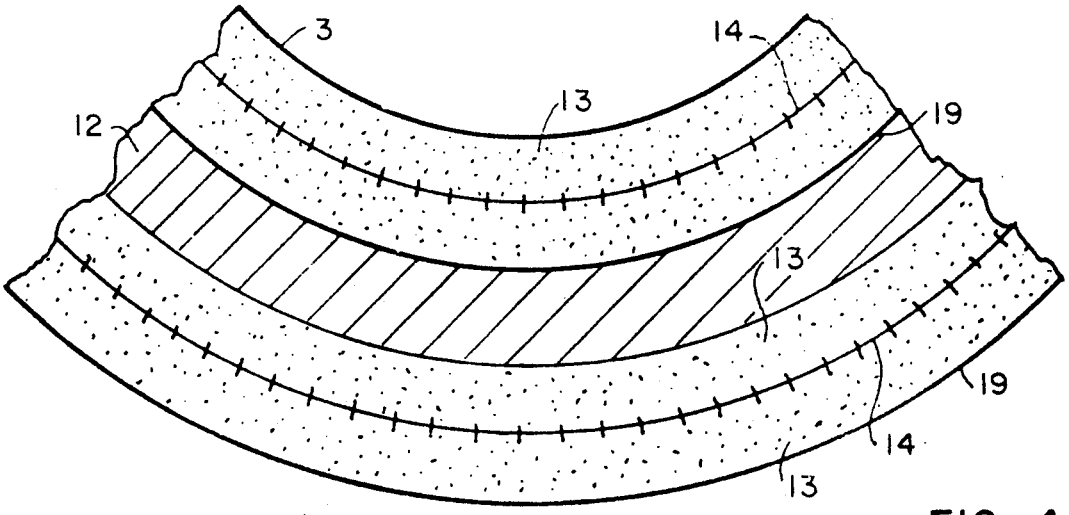
FIG. 4 is a cross section taken along lines 4—4 of FIG. 1.
Figure 5:
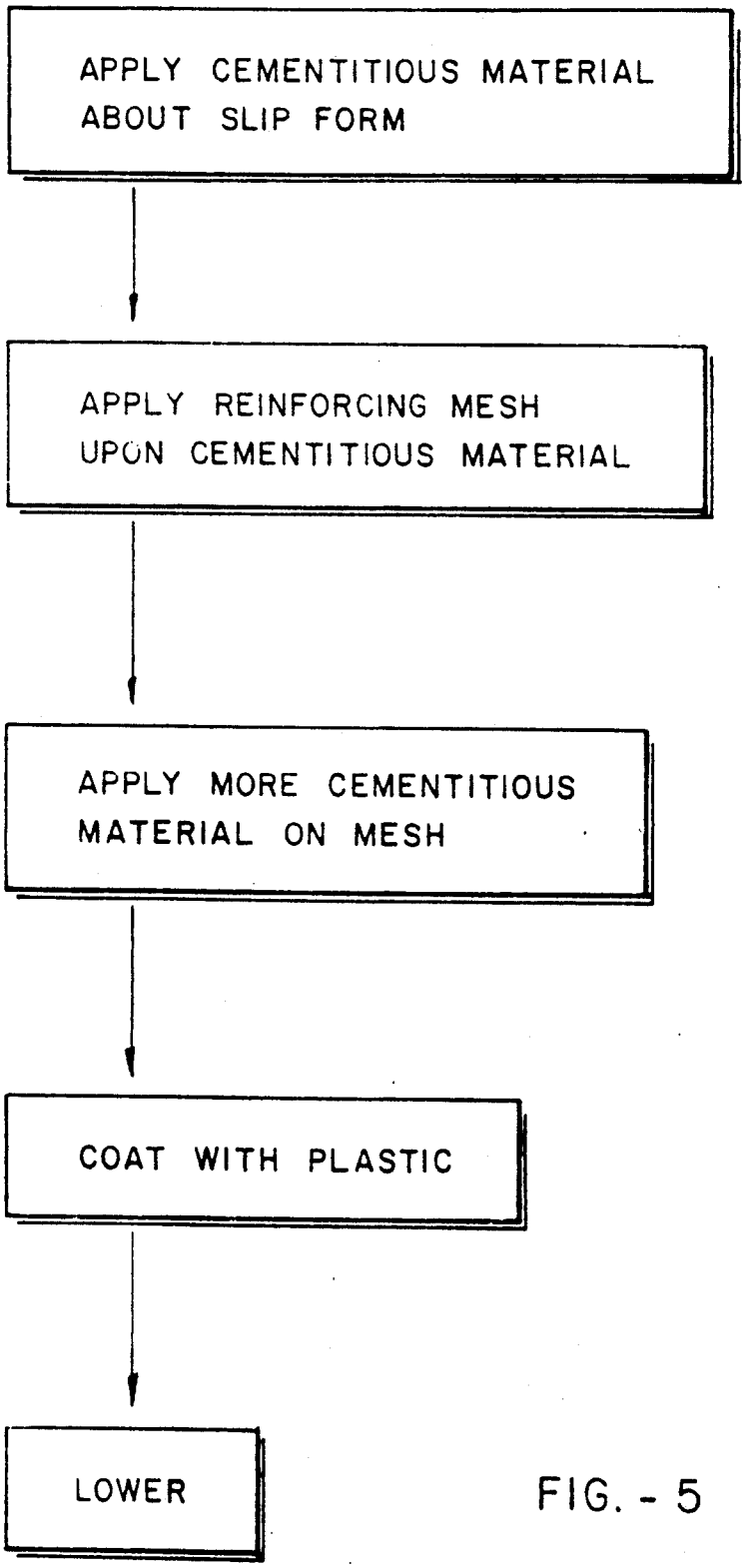
FIG. 5 is a flow diagram illustrating a method preferred in using the apparatus.

As the column is fabricated (to be defined) and develops negative buoyancy, it and the attached bottom structure 1 are lowered under control of a cable 4 in the central cavity or multiple cables 5 incorporated in the wall. If the construction site is outside the delivery area of a readymix concrete supplier, a portable batch plant and a supply of cement and aggregate are placed on the floating platform 2. In FIG. 2, a concrete pump, an air compressor, and a seat for an operator are mounted on a self-propelled cart 10 circling the moonpool M. When no moonpool is present, the pump cart can travel on a circular platform suspended from the same boom (not shown) used to support the form. The hopper of the pump is filled with concrete each time the cart 10 passes a mixer station. As the pump cart 10 circles the form, a continuous spray of concrete is directed onto the surface of the form.

Another cart 11 following behind the spray cart 10 dispenses reinforcing wire 14 or mesh under sufficient tension to partially embed or hold the reinforcing in position against the surface of the concrete previously placed. Successive encircling passes of the two carts 10, 11 create a laminate composed of multiple layers of concrete and horizontal reinforcing which may include vertical reinforcing 5 (FIG. 1) and the supporting cables 4 with or without chases.

Void formers and compressed air lines leading to the surface may also be enclosed in the laminate in order to create air chambers at various levels for regulating buoyancy.

The encircling pathway P supporting the carts may be raised or lowered in order to facilitate the installation of voids or inclusions which would complicate continuous slipforming, thus enabling a full vertical section to be completed before being lowered.

Encircling platforms and equipment may be placed at two or more levels to permit the continuous slipforming of multiple walls with spaces between. The inner wall with its reinforcing is completed at the top level. Web frames, cable chases, void formers, and other inclusions are placed at the next lower level or levels, and the outer wall is produced at the lowest level.

Large, thick-walled columns, may use additional spray 10 and reinforcing 11 machines in tandem on the same level to increase production.

When the column 30 can be fully completed in a free floating state, the spray ring and reinforcing equipment may be fixed to the production platform and the column and formwork rotated.

When the wall reaches design thickness and negative buoyancy, the column is allowed to slip downwards under control of the supporting cable 4 or cables 5.

Bell and spigot joints (not shown) with "O" rings or gaskets permit limited movement between column sections 30. Adjusting the length of the column section 30 can prevent buckling in most cases where the pipe must be laid on an uneven slope as in the case of land-based OTEC plants and outfall sewers. Elbows or bellows type joints may be used for sharp changes in slope.

Joints can be kept in compression if the supporting cables are in chases because all pipe sections are free to slip down and rest on the sections below. The compressive load on the joints can be adjusted by flooding or forcing air into the air chambers at various levels in the pipe column.

If an OTEC pipe or outfall sewer must be laid in a trench, or over an uneven slope, a separate pulley and cable loop (not shown) are attached to the bottom structure 1 while it is still at the surface. When the bottom structure 1 and attached pipe 30 reach bottom, the cable loop is taken ashore to the point where the pipe is to finally emerge. Dragline buckets are attached to the cable and pulled back and forth to remove protuberances along the line of the pipe and scoop out a trench if the nature of the seabed permits.

More sections are produced at the surface and lowered while the production platform is slowly moved toward shore allowing the pipe to settle onto the bottom or into the prepared trench.

If the production platform was designated to support a shore-based OTEC plant, the pipe may be left connected while the platform is moved into a basin dredged out of the shore. The basin is then backfilled. When the OTEC plant is to be fully afloat, construction is much simpler because the pipe is shorter and fewer joints are required.

More specifically, in FIG. 1 a bottom structure 1 is positioned below the moonpool M of a moonpool 2 and held in place against the bottom of slipform 3 by cable 4 in the hollow of slipform 3 or by cables 5 which will be incorporated in the column wall 30. A pneumatic or other type buffer 7 protects the completed column from damaging contact with the sides of the moonpool. A frame 8 supports the slipform 3 and pulleys 9 used to control the lowering of the column 30. For illustrative purposes the equipment needed to spray 10, reinforce 11, and place voids 12, cables 5, or other inserts within the column wall during slipforming are shown in vertical alignment, whereas in practice the equipment would be arranged in tandem around the circumference of the slipform 3 at deck level as suggested in FIG. 2. The equipment may be mobile and travel around the form or may be fixed to the deck while the form and supporting frame are rotated. The latter method is not suitable when the bottom structure is to rest on the sealed. Slipforming may be continuous or intermittent, but, in any event, a first layer of concrete 13 is applied to the form 3 followed by reinforcing 14 most commonly in the form of welded or woven wire fabric and a further layer of concrete 15 covers the reinforcing. At this point, inserts such as supporting cables 5, void formers 12, insulation, air lines, and other inclusions not shown are positioned on the form and encased in concrete 16 which is defined by an outer column wall completed with another layer of reinforcing 17 and concrete 18. A final waterproof coating or wrapping of plastic film 19 is applied before immersion to protect the green concrete from washout or attack by the sulfates in seawater.

Having thus described the invention, it should be apparent that numerous structural modifications are possible as suggested above and defined by the claims.

I claim:

1. An apparatus for slipforming tubing offshore comprising in combination:

means to support tubing extending from a single slipform, means for alternatively applying cementitious material and reinforcing on one side of the single said slipform to form said tubing, means to lower said tubing formed from said cementitious material and reinforcing into water, and means to protect uncured cementitious material from washing away in water.

2. The apparatus of claim 1 wherein said tubing support means is a cable suspended from an overhead support.

3. The apparatus of claim 2 wherein said applying means is a rotatable platform circumscribing the slipform; having a spray station and a reinforcing wire station to apply cement and wire respectively to the slipform.

4. The apparatus of claim 3 wherein said lowering means is a winch.

5. The apparatus of claim 4 wherein said protective means is a sheath wrapped on said tubing prior to lowering in the water.

6. An apparatus for offshore slipforming tubing comprising in combination:

means to support a bottom structure below a solitary slipform having one surface against which tubing is formed, means for alternately applying cementitious material and reinforcing onto the said surface of said solitary slipform, thereby forming tubing, means to lower said bottom structure and tubing formed from said cementitious material and reinforcing into water, means to protect uncured cementitious material from washing away in water, a void forming means circumscribing a wall formed by said reinforcing and cementitious material, means for coating an exterior of said void forming means with more reinforcing and cemetitious material, whereby as the tubing is lowered into the water, said void forming means creates a second wall about said tubing and spaced from said tubing by the thickness of said void forming means.

7. The apparatus of claim 6 wherein said bottom structure is connected to said tubing by cable means.

8. The apparatus of claim 7 wherein said void forming means includes a structure placed adjacent to an outer surface of said tubing and acting as a slipform, and cementitious material is placed thereover.

9. The apparatus of claim 8 wherein (wire) reinforcing is embedded in said cementitious material outside said void forming means.

10. An apparatus for producing laminated structures offshore formed by spraying cementitious material against a surface of a reuseable solitary form, then applying reinforcing on the cementitious material and finally spraying more cementitious material on the reinforcing, comprising, in combination:

means to support said solitary form, means to spray the cementitious material on said form, means to apply the reinforcing on the cementitious material, means to spray cementitious material on the reinforcing, means to support the resulting laminated structures of reinforcing and cementitious material and means to translate said form and laminated structure relative to each other to remove said form from the structure.

11. An apparatus for producing laminated structures formed by spraying cementitious material against a surface of a reuseable solitary form, then applying reinforcing on the cementitious material and spraying more cementitious material on the reinforcing, comprising, in combination:

means to support said solitary form, a station having means for sequentially spraying cementitious material, then reinforcing, followed by more cementitious material on said solarity form, means to support the resulting laminated structures of reinforcing and cementitious material and means to translate said form and laminated structure relative to each other to remove said form from the structure.

* * * * *